United States Patent [19]

Gomersall

[11] 4,406,314

[45] Sep. 27, 1983

[54] VALVE ACTUATORS

[76] Inventor: Rodney Gomersall, The Bungalow, 82, Banks Rd., Slaithwaite, Nr. Huddersfield, West Yorkshire, England

[21] Appl. No.: 239,857

[22] Filed: Mar. 2, 1981

[51] Int. Cl.[3] ..... B65B 3/04

[52] U.S. Cl. ..... 141/4; 141/70; 141/302; 141/354

[58] Field of Search ..... 137/853; 141/1, 285–310, 141/346–350, 351, 352, 353, 354, 355, 356, 357, 358, 359, 360, 361, 362, 382–386, 2–11, 69–70, 63, 64, 19, 329, 330; 277/177

[56] References Cited

U.S. PATENT DOCUMENTS 3,027,922 4/1962 Weston et al. ..... 141/354

3,286,741 11/1966 Gellman ..... 137/853

*Primary Examiner*—Houston S. Bell, Jr.

*Attorney, Agent, or Firm*—John C. Smith, Jr.

[57] ABSTRACT

A valve actuator is adapted to connect between an outlet valve of the type having a projecting operating needle on a pressure vessel and an inlet valve on a container, and comprises a coupling having securing means to releaseably secure the actuator to the body of the outlet valve. The coupling has a bore within which a piston is arranged to slide, and the piston is adapted to engage with the operating needle on sliding movement of the piston relatively to the coupling, to operate the outlet valve.

15 Claims, 4 Drawing Figures

VALVE ACTUATORS

Figure 1:
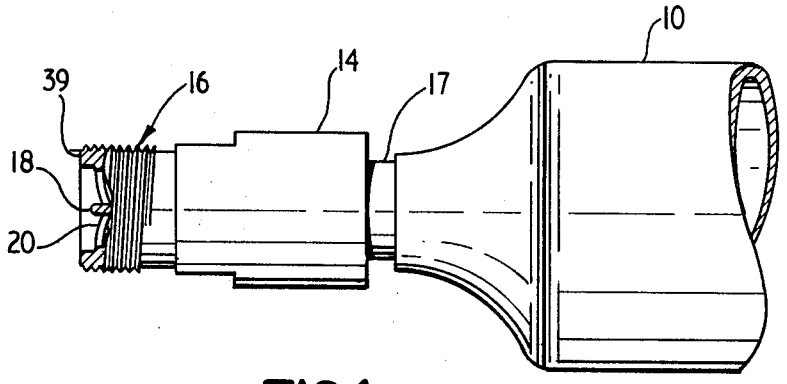

The invention relates to valve actuators and more particularly, but not exclusively to valve actuators which control the release of a pressurised fluid.

According to the invention, a valve actuator adapted to connect between an outlet valve of the type having a projecting operating needle on a pressure vessel and an inlet on a container, comprises a coupling having securing means to releasably secure the actuator to the body of the outlet valve, the coupling having a bore within which a piston is arranged to slide, the piston being adapted to engage the operating needle on sliding movement of the piston relatively to the coupling, to operate the outlet valve.

Preferably, the piston has a passageway formed therethrough, the passageway being in communication with the bore at an inner end of the piston, and providing an outlet for the coupling at the outer end of the piston forming a nozzle which is engageable with the inlet valve so that the inlet valve is in communication with the outlet valve via the passageway and the bore.

Preferably, also the coupling is adapted to be releasably secured and sealed on to the outlet end of the outlet valve, the piston being adapted to engage with the needle of the outlet valve to open that valve, the piston also being adapted to engage with a part of the inlet valve whereby, when the nozzle is pressed on to the inlet valve, the resulting movement between the piston and the coupling causes the piston to depress the operating needle to open the outlet valve allowing fluid to escape from the pressure vessel through the bore and the passageway to the inlet valve.

The inner end of the piston may have a head portion adapted to engage with the operating needle to open the outlet valve. A sealing means may be provided between the bore and the piston to prevent the flow of fluid therebetween, and the sealing means may comprise an 'O' ring. The outer end of the piston preferably has a safety valve connected thereto. The safety valve may comprise a port leading from the passageway to the outside of the piston, the outlet of the port being covered with a sleeve which is arranged to distend when a predetermined pressure is exerted on it to allow the passage of fluid from the passageway through the port to prevent an excessive build up of pressure within the passageway. The sleeve may be formed of rubber or a plastics material. The sleeve may be a tight fit on the piston so that the piston is moved relatively to the coupling on corresponding movement of the sleeve.

The securing means may comprise a screw-threaded connector. A second sealing means may be provided on the coupling, the second sealing means being arranged to prevent the passage of fluid between the coupling and the outlet valve. The second sealing means may comprise an 'O' ring.

The invention includes a method of controlling the injection of a pressurised fluid into a container comprising securing and sealing a valve actuator in accordance with the invention to an outlet valve having a projecting operating needle on a pressure vessel, and pressing the piston of the actuator into contact with an inlet valve of the container so that the piston moves relatively to the coupling body and engages the operating needle causing operation of the outlet valve. The method may also comprise the engagement of the piston with the operating needle to cause opening of the outlet valve, a pressurised fluid thereby issuing from the pressure vessel through the actuator and to the inlet valve of the container so that the fluid is injected through the inlet valve into the container.

Figure 2:
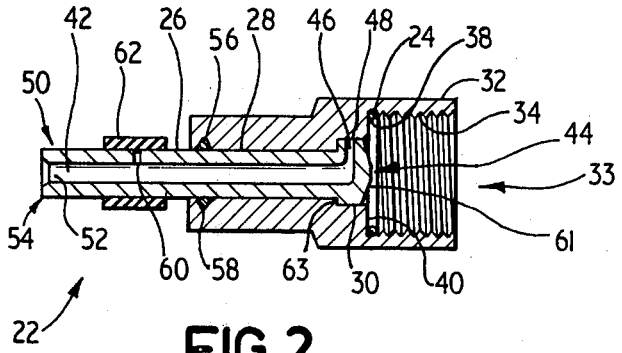
Figure 4:
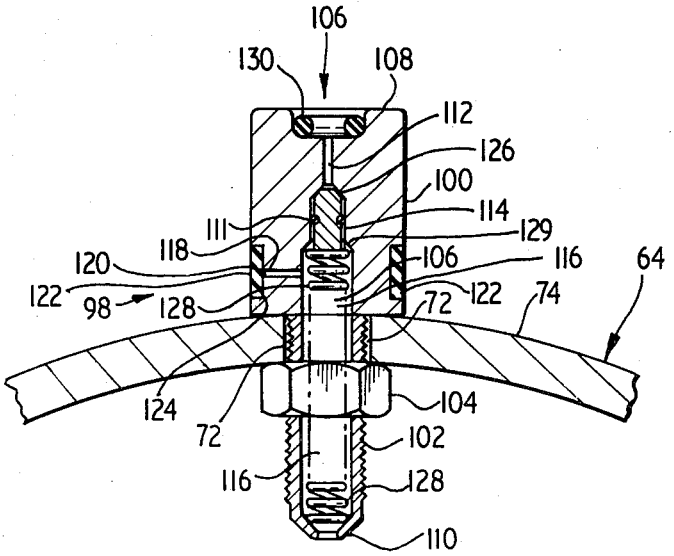
Figure 3:
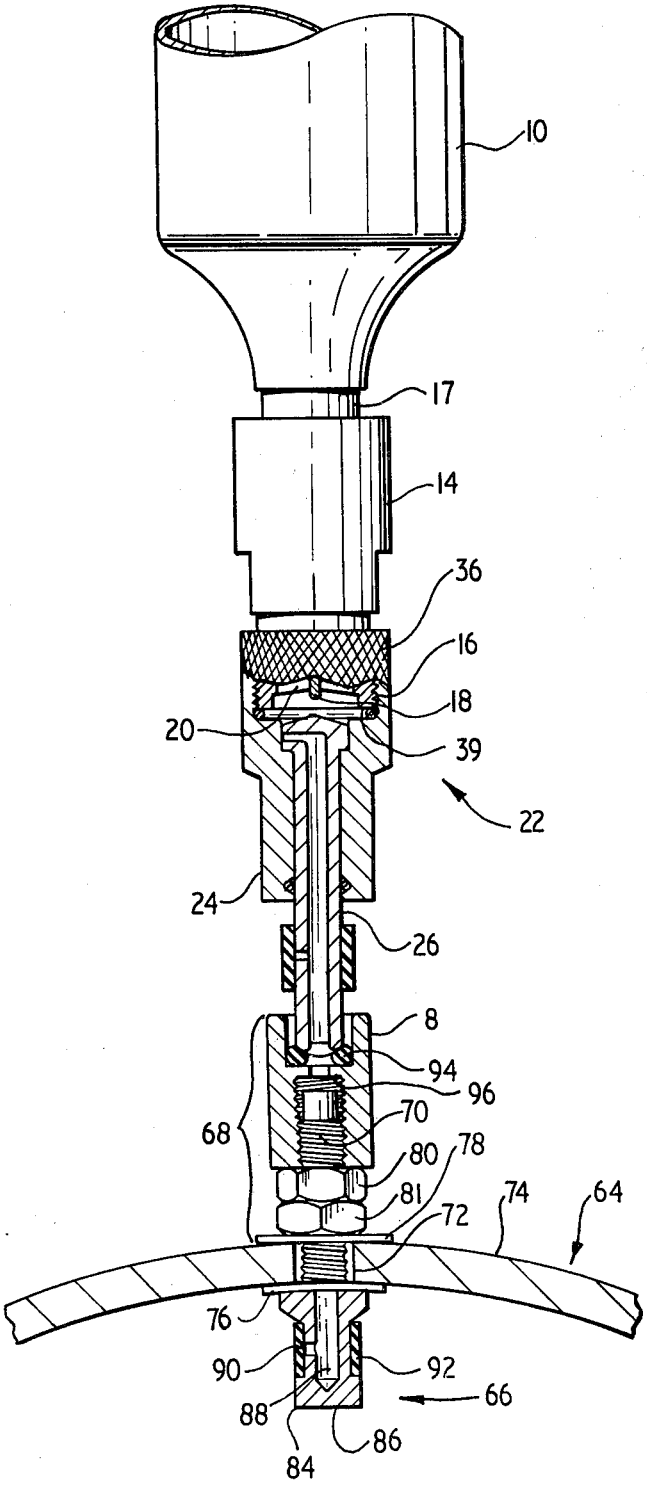

One embodiment of a valve actuator in accordance with the invention will now be described, by way of example only, with reference to the accompanying drawings of which:

FIG. 1 is a partly sectioned diagrammatic side elevation of a pressurised cylinder having an outlet valve secured thereto, FIG. 2 is a sectional side elevation of a valve actuator, FIG. 3 is a partly sectioned side elevation of an arrangement of an actuator as shown in FIG. 1 connected between the outlet valve of the pressurised cylinder shown in FIG. 2 and an inlet valve of a container, and FIG. 4 is a sectional side elevation of an alternative inlet valve of a container.

In home beer brewing, the beer is usually stored in a keg and it is offen necessary to carbonate the beer. For this purpose the keg is provided with an inlet valve, and an adapter secured on the outside of the inlet valve receives a gas bulb containing carbon dioxide. The bulb is pierced by a pin in the adapter when pressed on to the adapter by use of a bulb carrier, and the carbon dioxide is thus allowed to escape from the bulb through the inlet valve into the keg. This method is well known and it is unnecessary to describe the apparatus used in detail. However, this apparatus suffers from the disadvantage that a fresh gas bulb has to be used for each operation since the bulb will always empty when pierced. Hence the process is expensive.

Carbonating cylinders containing pressurised carbon dioxide are available, such as that illustrated at 10 in FIGS. 1 and 3, and the cylinder 10 is capable of being used in accordance with the invention for carbonating beer (not shown) in a keg. The cylinder 10 has an outlet valve 14 which has an externally screw-threaded portion 16. The valve 14 is welded onto the outlet 17 of the cylinder 10 and has an operating needle or spindle 18 which is housed within a recess 20 of the valve 14. The operating spindle 18 is spring loaded outwardly and when the spindle 18 is depressed against the action of the spring loading the valve 14 is opened allowing carbon dioxide to escape from the cylinder 10.

A valve actuator adapted to cause opening of the valve 14 is indicated generally at 22 and comprises a coupling 24 and a piston 26. The piston 26 is mounted in a small bore 28 formed axially within the coupling 24 at one end thereof. The small bore 28 communicates with an intermediate bore 30 which in turn communicates with a large bore 32 at the other end of the coupling 24. The bores 28, 30 and 32 together define a duct 33 which extends longitudinally through the coupling 24. The large bore 32 is internally screw-threaded at 34, and this part of the bore 32 is arranged to be threaded onto the portion 16 of the valve 14 to connect the actuator 22 to the valve 14. The external surface 36 of the said other end of the actuator 22 is knurled to facilitate the connection of the actuator to the valve 14.

An 'O' ring 38 is located on a shoulder 40 of the coupling 24 where the intermediate bore 30 communicates with the large bore 32. The 'O' ring 38 is arranged to be engaged by an outer rim 39 of the valve 14 when the actuator is connected to the valve 14 to provide a seal between the shoulder 40 and the rim 39.

The piston 26 has a longitudinal passageway 42 formed therein and at the rear end 44 of the piston a radial port 46 extends into the piston and communicates between the end of the passageway 42 and an aperture 48 on the outside of the end 44 of the piston. The piston 26 extends outwardly from the coupling 24 and the outer end 50 of the piston, together with the outer end 52 of the passageway 42 which passes therethrough, forms a nozzle 54.

A second 'O' ring 56 is located in a recess 58 around the inside of the small bore 28, and provides a seal between the small bore 28 and the piston 26. At the outer end 50 of the piston 26, a further radial port 60 is formed through the piston 26 and communicates between the outer end 52 of the passageway 42 and the outside of the piston 26. A circular rubber membrane 62 fits tightly on the outside of the outer end 50 of the piston 26 and covers the port 60. The port 60 and the membrane 62 together form a safety valve for the actuator 22 so that if a predetermined gas pressure in the passageway 42 is exceeded, which could happen, for instance, if the actuator 22 where coupled to the valve 14 and the valve was opened when the nozzle 54 was blocked, the membrane 62 distends and allows the gas to pass out of the passageway 42 through the port 60. The membrane 62 is a tight fit on the piston 26 so that an axially directed force on the membrane 62 causes the piston 26 to slide within the small bore 28. The rear end 44 of the piston 26 is bevelled and forms a hammer 61 which is normally housed within the intermediate bore 30 but which is adapted to strike the spindle 18 of the valve 14 when the piston 26 slides within the duct 33, the resulting depression of the spindle 18 causing opening of the valve 14. The hammer 61 is arranged to engage with a shoulder 63 of the coupling at the intersection of the small bore 28 and the intermediate bore 30 to prevent the piston 26 from being forced out through the small bore 28 under the pressure of carbon dioxide issuing from the cylinder 10 when the valve 14 is opened.

In FIG. 3 there is shown a portion of a keg 64 which is arranged to contain home brewed beer (not shown). The keg 64 is provided with an inlet valve 66 and an adapter 68 which are adapted to be connected to the actuator 22 and the cylinder 10 when it is required to carbonate the beer (not shown) in the keg 64.

The inlet valve 66 has a hollow threaded connector stud 70 formed thereon, and the stud 70 is located through an aperture 72 formed in the side wall 74 of the keg 64. A rubber washer 76 is located on the inlet valve 66 on the inside of the keg 64, the washer 76 abutting the inside of the side wall 74. A metal washer 78 is located on the stud 70 and abutts the side wall 74 on the outside of the keg 64. A pair of lock nuts 80 and 81 are threaded onto the stud 70 and are tightened against the metal washer 78 to firmly secure the inlet valve 66 and adapter 68 in place on the keg 64. An internally threaded end cap 82 is threaded on to the outer end of the stud 70 and is tightened on to the upper lock nut 80, the washers 76 and 78 being forced against the inside and outside of the side wall 74, respectively.

The inlet valve 66 comprises a valve sleeve 84 which is closed at its inner end 86 defining a cavity 88 within the sleeve. A hole 90 is formed radially through the side wall of sleeve 84 and connects the cavity 88 with the outside of the sleeve 84. A rubber seal 92 is located around the sleeve 84 and covers the hole 90 on the outside of the sleeve. Gas is thus arranged to pass from the cavity 88 through the hole 90 and into the keg 64 on distention of the rubber seal 92 when a predetermined pressure of gas within the cavity 88 is reached. The seal 92, however, closes over the hole 90 to prevent the passage of gas back through the hole 90 when the pressure of gas in the cavity 88 is reduced below the said predetermined pressure. The inlet valve 66 is thus a one way valve allowing gas to pass into the keg 64 but preventing the flow of gas in the opposite direction, out of the keg.

An 'O' ring 94 is located on an internal flange 96 on the inside of the end cap 82 at the outer end thereof.

When it is required to carbonate the beer (not shown) in the keg 64, the actuator 22 is screwed onto the portion 16 of the valve 14, as previously described, and tightened thereon until the outer rim 39 of the valve 14 is forced into engagement with the 'O' ring 38 to seal the connection between the shoulder 40 and the rim 39. The nozzle 54 of the actuator 22 is then inserted into the outer end of the end cap 82 as shown in FIG. 3, and is pressed firmly against the 'O' ring 94 in the end cap, the 'O' ring 94 forming a seal around the nozzle 54. The nozzle 54 is pressed into the end cap 82 until the membrane 62 engages on the outer end of the end cap 82 and the membrane is then forced into firmer contact with the end cap so that the piston 26 slides inwardly relatively to the coupling 24 until the hammer 61 of the piston 26 strikes the spindle 18 of the valve 14. The valve 14 then opens and the pressurised carbon dioxide from the cylinder 10 escapes through the valve 14 and the duct 33 via the port 46, and out of the nozzle 54. The carbon dioxide passes on through the end cap 82 and the stud 70 and into the cavity 88 in the inlet valve 66. When sufficient carbon dioxide has entered the cavity 88 from the cylinder 10, the rubber seal 92 distends and the carbon dioxide passes from the cavity 88 through the hole 90 and into the keg 64.

To stop the carbonating process, the force which is exerted to press the membrane 62 onto the end cap 82 is released. The carbon dioxide issuing from the valve 14 then presses on the piston 26 causing the latter to slide outwardly relative to the coupling 24 so that the hammer 61 is forced out of engagement with the spindle 18. The spring loading of the spindle 18 then urges the valve 14 to close thus preventing any further carbon dioxide escaping from the cylinder 10. The nozzle 54 can then be removed from the end cap 82, the rubber seal 92 preventing the escape of carbon dioxide back through the inlet valve 66 and out of the keg 64.

In FIG. 4 there is shown an alternative form of inlet valve for the keg 64. The alternative form of inlet valve is indicated generally at 98 and comprises a boss 100 having a threaded shank 102 formed thereon. The shank 102 passes through the aperture 72 formed in the side wall 74 of the keg 64, and the inlet valve 98 is secured to the keg 64 by means of a nut 104 which is threaded onto the end of the shank 102 on the inside of the keg. The nut is rotated on to the shank 102 until the boss 100 is tightened on to the outside surface of the side wall 74. A passageway 106 is formed axially through the boss 100 and the shank 102. The passageway 106 is in communication with a recess 108 at the outer end of the boss 100, and extends through an inner tapered end 110 of the shank 102 on the inside of the keg 64. The passageway 106 has a narrow bore 112 where it connect with the recess 108 and flares outwardly at its central portion forming an intermediate bore 114. The inner end of the passageway 106 is again flared outward by from the intermediate bore 114 to form a large bore 116.

A port 118 communicates between the large bore 116 and a hole 120 formed through the external surface of the boss 100. The hole 120 is covered by a distendable rubber membrane 122 which fits snugly around the boss 100 in a recess 124 formed circumferentially on the boss 100. The port 118 hole 120 and membrane 122 together form a safety valve for the keg 64 such that when a predetermined pressure exists within the keg 64, the membrane 122 is distended and gas is allowed to escape from the passageway 106 via the port 118 and the hole 120 to the outside of the keg 64, so that the pressure within the keg 64 is reduced.

A sealing plug 124 is tapered at its outer end 126 and is forced into engagement with the tapered outer end of the intermediate bore 114 by a compression spring 128 which acts between the inner end 129 of the plug 124 and the inner tapered end 110 of the shank 102, the compression spring 128 being secured to the tapered end 110. An 'O' ring 111 is secured around the plug 124 and provides a seal between the plug 124 and the intermediate bore 114. The plug 124 is normally housed within the intermediate bore 114 but the pressure of a gas entering the passageway 106 through the narrow bore 112 forces the plug 124 into the large bore 116 against the action of the compression spring 128, the gas passing around the plug 124, through the passageway 106 and into the keg 64.

A 'O' ring 130 is located within the recess 108 and is arranged to be engaged by the nozzle 54 of the actuator 22 and thus serves the same purpose as the 'O' ring 94 on the inlet valve 66. When the nozzle 54 is pressed firmly onto the 'O' ring 130 to depress the spindle 18 and open the valve 14, as previously described with reference to FIG. 3, pressurised carbon dioxide from the cylinder 10 thus flows through the passageway 106 into the keg 64, the plug 124 being forced into the large bore 116 as previously mentioned so that the carbon dioxide flows around and past the plug 124 into the keg 64. When the nozzle 54 is withdrawn from the 'O' ring 130 the valve 14 closes and carbon dioxide ceases to flow through the passageway 106 and into the keg 64. The plug 124 is then forced into engagement with the intermediate bore 114 under the action of the spring 128 and by virtue of the gas pressure exerted on it from within the keg 64. The 'O' ring 111 ensures that gas does not leak out of the keg 64 through the passageway 106 between the plug 124 and the intermediate bore 114.

The carbon dioxide is thus effectively injected into the keg 64 via the outlet valve 14, the actuator 22 and one of the inlet valves 66 or 98. The amount of carbon dioxide injected into the keg 64 is controlled by the force exerted to keep the nozzle 54 in contact with the 'O' ring 94 in the end cap 82, or the 'O' ring 130 on the boss 100, which causes the hammer 61 to press against the spindle 18 to open the valve 14. The amount of carbon dioxide injected into the keg 64 is therefore capable of being limited to only that amount which is necessary to fully carbonate the beer (not shown), unlike conventional carbonating processes in which the whole of the carbon dioxide contained within a gas bulb is used for carbonating the beer. Any surplus carbon dioxide contained in the bulb which is not required for carbonating the beer is therefore wasted. Any surplus of carbon dioxide which remains in the cylinder 10 after the carbonating process is completed can, however, be used for carbonating beer in other kegs.

The keg 64 could, if required, be provided with a safety valve (or an additional safety valve to that provided on the inlet valve 98) in order that the pressure of carbon dioxide within the keg can be relieved by the safety valve if that pressure exceeds a predetermined value. Also, the keg could be provided with a pressure gauge so that the pressure of carbon dioxide within the keg may be monitored.

I claim:

1. A valve actuator adapted to connect between an outlet valve of the type having a projecting operating needle on a pressure vessel and an inlet valve on a container, comprising a coupling having securing means to releasably secure the actuator to the body of the outlet valve, the coupling having a bore therein extending through said coupling, a piston arranged to slide within said bore and sealing means between the bore and the piston to prevent the flow of fluid therebetween, said piston being adapted to engage the operating needle of said outlet valve on sliding movement of the piston relatively to the coupling to operate the outlet valve.

2. A valve actuator as claimed in claim 1, in which the piston has inner and outer ends and a passageway formed therethrough, the passageway being in communication with the bore at said inner end of the piston, and providing an outlet for the coupling at the outer end of the piston, and wherein the outer end of the piston forms a nozzle which is engageable with the inlet valve so that the inlet valve is in communication with the outlet valve via the passageway and the bore.

3. A valve actuator as claimed in claim 2, in which the coupling is adapted to be releasably secured and sealed on to the outlet end of the outlet valve, the piston being adapted to engage with the needle of the outlet valve to open that valve, the piston also being adapted to engage with a part of the inlet valve whereby, when the nozzle is pressed on to the inlet valve, the resulting movement between the piston and the coupling causes the piston to depress the operating needle to open the outlet valve allowing fluid to escape from the pressure vessel through the bore and the passageway to the inlet valve.

4. A valve actuator as claimed in claim 3, in which the inner end of the piston has a head portion adapted to engage with the operating needle to open the outlet valve.

5. A valve actuator as claimed in claim 1, in which the sealing means comprises an 'O' ring.

6. A valve actuator as claimed in claim 2, in which the outer end of the piston has a safety valve connected thereto.

7. A valve actuator as claimed in claim 6, in which the safety valve comprises a port leading from the passageway to the outside of the piston, the outlet of the port being covered with a sleeve which is arranged to distend when a predetermined pressure is exerted on it to allow the passage of fluid from the passageway through the port to prevent an excessive build up of pressure within the passageway.

8. A valve actuator as claimed in claim 7, in which the sleeve is formed of rubber or a plastic material.

9. A valve actuator as claimed in claim 7, in which the sleeve is a tight fit on the piston so that the piston is moved relatively to the coupling on corresponding movement of the sleeve.

10. A valve actuator as claimed in claim 1, in which the securing means comprises a screw-threaded connector.

11. A valve actuator as claimed in claim 3, in which a second sealing means is provided on the coupling, the second sealing means being arranged to prevent the passage of fluid between the coupling and the outlet valve.

12. A valve actuator as claimed in claim 11, in which the second sealing means comprises an 'O' ring.

13. A method of injecting a pressurized fluid into a container comprising securing and sealing a valve actuator to an outlet valve having a projecting operating needle on a pressure vessel; said valve actuator comprising a coupling, a bore extending through said coupling, means at one end of said bore for releasably securing said valve actuator to said outlet valve, an elongated piston arranged to slide within said bore in said coupling, sealing means between said bore and said piston to prevent flow of fluid therebetween, and a passageway extending through said piston; and pressing the piston of the actuator into contact with an inlet valve of the container so that the piston moves relatively to the coupling body and engages the operating needle causing the outlet valve to open; whereby said pressurized fluid issues from the pressure vessel through the passageway in said piston and to the inlet valve of the container so that the pressurized fluid is injected through the inlet valve into the container.

14. A valve actuator adapted to connect between an outlet valve of the type having a projecting operating needle on a pressure vessel and an inlet valve on a container, comprising:

(a) a coupling;

(b) a bore extending through said coupling;

(c) means at one end of said bore for releasably securing said actuator to said outlet valve;

(d) an elongated piston arranged to slide within said bore in said coupling, one end of said piston being adapted to engage said operating needle of said outlet valve and the opposite end of said piston projecting from said bore;

(e) sealing means between said bore and said piston to prevent flow of fluid therebetween; and (f) a passageway extending through said piston, one end of said passageway being in communication with said bore adjacent said securing means and the opposite end of said passageway forming a nozzle at said opposite end of said piston for engaging with said inlet valve;

(g) whereby said opposite end of said piston may be engaged by said inlet valve, said piston may be slid within said bore to engage and depress said operating needle and said outlet valve may be opened so that the pressurized fluid in said pressure vessel is injected through said inlet valve into said container.

15. A valve actuator as claimed in claim 14 wherein a first portion of said bore in said coupling at said one end is of greater diameter than the second portion thereof adjacent thereto, the sidewall of said piston adjacent said one end thereof has an aperture therein and is in contact with the sidewall of said second portion of said bore when said outlet valve is closed, said one end of said passageway terminating at said aperture whereby said one end of said passageway is closed by said sidewall of said bore when said outlet valve is closed and when said piston is slid within said bore to depress said operating needle and open said outlet valve said aperture is moved from said second portion of said bore to said first portion of said bore whereby said passageway is opened for the passage of pressurized fluid therethrough from said outlet valve of said pressure vessel.

* * * * *